United States Patent [19]

Chang et al.

[11] 3,951,642

[45] Apr. 20, 1976

[54] METALLIC COATING POWDER CONTAINING Al AND Hf

[75] Inventors: David R. Chang, Cincinnati; John J. Grisik, Middletown, both of Ohio

[73] Assignee: General Electric Company, Cincinnati, Ohio

[22] Filed: Nov. 7, 1974

[21] Appl. No.: 521,860

[52] U.S. Cl. ..... 75/.5 R; 75/.5 BB; 427/192; 427/253

[51] Int. Cl.[2] ..... C22C 1/04; B32B 15/00

[58] Field of Search ..... 75/.5 BB, .5 R; 427/252, 253, 192

[56] References Cited

UNITED STATES PATENTS

| | | | |
|---|---|---|---|
| 3,528,861 | 9/1970 | Elam et al. | 148/11.5 F |
| 3,540,878 | 11/1970 | Levine et al. | 75/.5 R |
| 3,560,252 | 2/1971 | Kennedy | 427/248 X |
| 3,667,985 | 6/1972 | Levine et al. | 427/190 X |

*Primary Examiner*—L. Dewayne Rutledge
*Assistant Examiner*—Arthur J. Steiner
*Attorney, Agent, or Firm*—Lee H. Sachs; Derek P. Lawrence

[57] ABSTRACT

A metallic article is provided with improved resistance to high temperature environmental conditions through the inclusion of about 0.1–10 weight percent Hf in an article surface, such as through coating. A method for providing such a coating includes application of the Hf alone or in combination with other surface protective means. Application of Hf can occur before, during or after use of such protective means.

3 Claims, 3 Drawing Figures

METALLIC COATING POWDER CONTAINING Al AND Hf

The invention herein described was made in the course of or under a contract, or a subcontract thereunder, with the United States Department of the Air Force.

BACKGROUND OF THE INVENTION

This invention relates primarily to metallic coatings and coated articles and, more particularly, to metallic coatings applied to metal articles for high temperature use.

As modern power generation apparatus, such as the gas turbine engine, has evolved, the environmental operating temperatures in its hotter sections have increased. Although metallurgists have developed improved alloys from which metallic components can be made, some are subject to surface deterioration such as through oxidation or hot corrosion, to a degree greater than that which is desirable. Therefore, concurrently with the evolution of such apparatus has been the development of high temperature operating surface treatments and coatings.

From the literature, it can be seen that a large number of such coatings involve the use of aluminum as an important ingredient in the coating. Earlier methods involved applying aluminum metal to the surface directly such as through dipping in molten aluminum or spraying molten aluminum onto the surface of an article. Such methods resulted in an increase in article dimensions. Therefore, in order to retain the critical dimensions of an article such as for use in gas turbines, the pack diffusion process was developed. One example of such a pack process is represented by U.S. Pat. No. 3,667,985 — Levine et al. issued June 6, 1972. Vapor deposition of high temperature coatings, including aluminum as an important ingredient, is shown in one form in U.S. Pat. No. 3,528,861 — Elam et al. issued Sept. 15, 1970. Another method for vapor depositing coatings on a substrate is shown in U.S. Pat. No. 3,560,252 — Kennedy issued Feb. 2, 1971. The disclosure of each of these patents is incorporated herein by reference.

Although a number of methods, compositions and mixtures have been developed for the purpose of inhibiting or retarding surface deterioration of articles exposed to the environment at elevated temperatures, each has its limitation in respect to the length of time it can afford protection.

SUMMARY OF THE INVENTION

It is a principal object of the present invention to provide an improved surface barrier including a system which is applicable to a variety of coating methods and materials, and which provides improved oxidation and sulfidation resistance to a metallic article with which it is associated.

Another object is to provide a metallic article having a surface portion of improved resistance to oxidation and sulfidation and capable of being applied in a variety of ways.

Still another object is to provide an improved coating material which can be used in improved methods for providing an article with an oxidation and sulfidation resistant barrier.

These and other objects and advantages will be more clearly understood from the following detailed description, the examples and the drawings, all of which are intended to be typical of rather than in any way limiting on the scope of the present invention.

The metal article associated with the present invention is provided with improved oxidation and sulfidation resistance through application of a metallic coating which includes, as one coating ingredient, the element hafnium in the range of 0.1–10 weight percent. In respect to the method associated with the present invention, the element Hf can be applied in a variety of ways. For example, the Hf can be applied to the article surface before coating or it can be applied to the coated surface after coating. In addition, it can be included in or with the coating material or ingredients, generally in powder form, from which the coating is generated. Thus, associated with the present invention is a novel coating powder and coating mixture material which can be used in the method to generate the article associated with the present invention.

DESCRIPTION OF THE PREFERRED EMBODIMENTS

The degree to which an aluminide-type coating can protect a metal surface, for example a nickel or cobalt base superalloy surface, depends on the coating's ability to generate a dense, adhesive $Al_2O_3$ layer. This protective oxide scale can separate and leave the surface, such as by spalling when stress due to thermal cycling is imposed, by mechanical erosion or by fluxing due to the presence of corrosive molten salts. Such removal of $Al_2O_3$ scale will lend to the depletion of Al and therefore the relatively rapid failure of the coating. It has been recognized through the present invention that the inclusion of hafnium in the coating can change the morphology of the $Al_2O_3$ formed and result in better oxide scale adherence and stability of the oxide scale in the presence of molten salts. The improvement in adherence is brought about by the hafnium oxide ($HfO_2$) causing keying of the oxide surface, such as through interlocking fingers, with the underlying balance of the coating. Thus, the presence of $HfO_2$ increases the stability of the $Al_2O_3$ generally resulting in at least a two-fold improvement in coating life.

Figure 1:
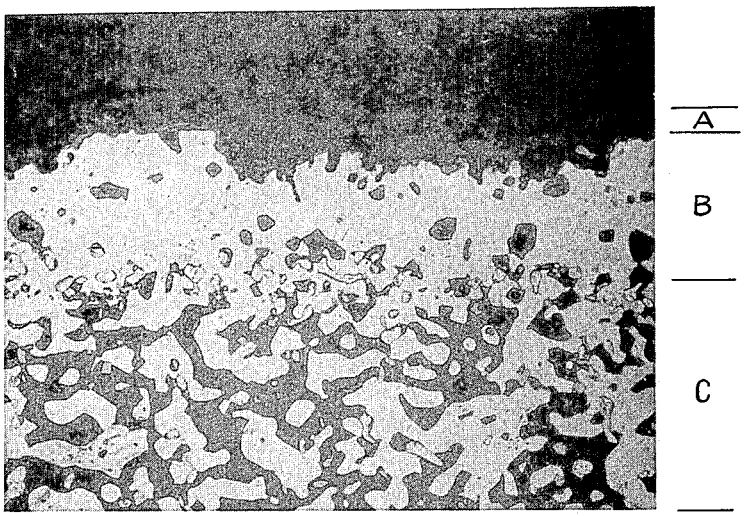
FIG. 1 is a photomicrograph at 500 magnifications of an aluminide coating including the element Hf, according to the present invention, after 850 hours in a 2100°F (1150°C) dynamic oxidation test.
Figure 2:
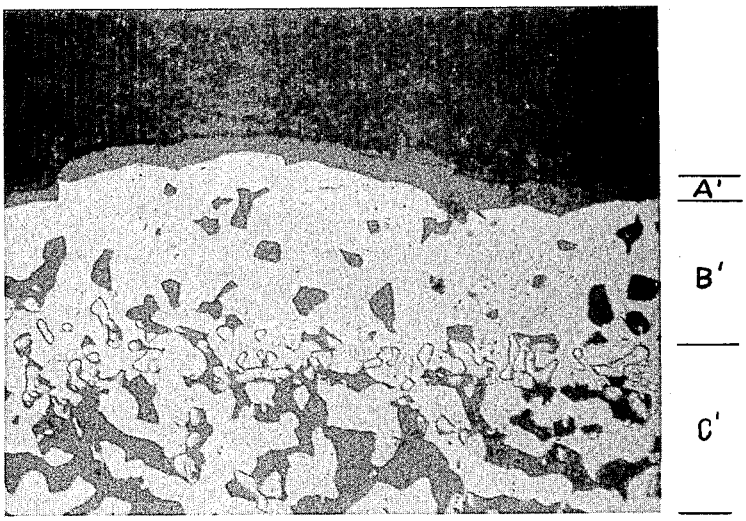
FIG. 2 is a photomicrograph at 500 magnifications of the same coating as in FIG. 1, applied in the same way to the same substrate but not including the element Hf in the surface portion, after 400 hours in the 2100°F (1150°C) dynamic oxidation test.

The type of keying or interlocking arrangement which results from the use of hafnium in connection with the present invention is shown by the typical photomicrograph in FIG. 1 at 500 magnifications after 850 hours exposure at 2100°F (1150°C) in air. That portion of the coating generally indicated as A is the outer surface portion or oxide scale, with B being the aluminide coating portion of the type described in the above-mentioned U.S. Pat. No. 3,667,985 diffused into C, the substrate portion of a Ni-base superalloy, sometimes referred to as René 120 alloy, and consisting nominally, by weight, of 0.17% C, 9% Cr, 4% Ti, 0.015% B, 4.3% Al, 7% W, 2% Mo, 10% Co, 3.8% Ta, 0.08% Zr with the balance essentially Ni and incidental impurities. The irregular, interlocking relationship between the oxide scale portion A and the aluminide coating portion B can be seen at the interface between those two portions. Referring to FIG. 2 in which like, primed letters identify like portions, the same aluminide coating, but without the inclusion of the element Hf as in the coating in FIG. 1, after only 400 hours exposure at 2100°F (1150°C) in air, results in a relatively smooth interface between oxide scale A′ and the aluminide B′. The significantly lower adherence of the oxide scale A′ in FIG. 2, resulting from the less desirable mechanical interlocking between the oxide scale and the underlying aluminide coating, leads to a significantly lower surface protection capability compared with the system shown in FIG. 1.

During the evaluation of the present invention, represented by the following typical examples, it has been recognized that the inclusion of Hf as an ingredient in a metallic coating, within the range of about 0.1–10 wt. %, provides the unusual adherence and stability characteristics of the basic $Al_2O_3$ scale, discussed in connection with FIGS. 1 and 2. However, below about 0.1 wt. % there has been found to be too little difference in the coating morphology to result in any significant change. Above about 10 wt. % Hf can be detrimental to the coating because $HfO_2$ is relatively porous; thus, when it is present in too great an amount, it allows the conduction of oxygen through the coating. Therefore, such large amounts of Hf in the coating will make the coating oxidize faster and fail more quickly than if no Hf were present.

Although there are a number of coatings which include Al and with which the present invention can be associated, the present invention has been extensively evaluated in connection with a diffusion aluminide coating method and material sometimes referred to as CODEP coating and described in above-mentioned U.S. Pat. No. 3,667,985. This type of coating is generated through the use of a coating source metal powder, which includes the element Al in an Al—Ti—C alloy, and a halide salt which will react with the coating powder at the coating temperature, generally in the range of 1200°–2100°F (650°–1150°C), to produce a metal halide from which the aluminum is deposited on an article surface to be coated. Such surface can be embedded in the coating powder, generally mixed with the halide salt and an inert extender, such as $Al_2O_3$ powder, or it can be held within a container including such a mixture so that the metal halide generated can contact the article surface to provide the coating. That form of such method in which the article to be coated is embedded in such a powder mixture is widely used commercially and is frequently referred to as the pack diffusion coating method.

EXAMPLES 1 – 6

The above-described type of pack diffusion coating process was used to apply an aluminide coating to a nickel-base superalloy, sometimes referred to as René 80 alloy, and consisting nominally, by weight, of 0.15% C, 14% Cr, 5% Ti, 0.015% B, 3% Al, 4% W, 4% Mo, 9.5% Co, 0.06% Zr, with the balance Ni and incidental impurities. Two types of pack mixtures were prepared. A first, called Pack A in the following Table, used the Al—Ti—C ternary alloy employed and claimed in U.S. Pat. No. 3,540,878 — Levine et al. issued Nov. 17, 1970 within the range, by weight, of 50–70% Ti, 20–48% Al and 0.5–9% combined C. Such a pack included 4 wt. % of such alloy in powder form along with 0.2 wt. % $NH_4F$, various amounts of hafnium powder from which the examples of the following Table were selected, the balance of the mixture being $Al_2O_3$. A second pack, called Pack B in the Table substituted 4% of an iron-aluminum powder for the Al—Ti—C alloy powder as the coating source. In this Pack B, the alloy consisted essentially of, by weight, 51–61% Al, with the balance Fe and was further characterized by being in the form of a two-phase structure of $Fe_2Al_5$ and $FeAl_3$. Such an alloy is described more fully in copending application Ser. No. 447,318, filed Mar. 1, 1974, the disclosure of which is incorporated herein by reference.

TABLE

COATING COMPOSITION VS. COATING LIFE

| Ex. | Pack | Hf (wt. %) in Pack | Hf (wt. %) in Coating | 2100°F Dynamic Oxidation (life in hr/mil) |
|---|---|---|---|---|
| 1 | A | 0.2 | 2 | 250 |
| 2 | A | 0.35 | 5–8 | 300 |
| 3 | A | 2. | 20 | 50 |
| 4 | A | 0 | 0 | 150 |
| 5 | B | 2 | 2 | 250 |
| 6 | B | 3 | 5–8 | 300 |

Although in these examples Hf was added as Hf powder, it should be understood that other convenient forms for addition of Hf to the pack include use of a hafnium halide, for example $HfF_4$, $HfCl_4$, etc. or an alloy or other compound including Hf.

One group of specimens of the above-described René 80 alloy were embedded in Pack A, another group in Pack B and all were processed in the range of 1900°–1950°F (1038°–1066°C) in hydrogen for about four hours in a series of evaluations to generate an aluminide coating, including varying amounts of Hf, diffused into the surface of the specimen. The above Table includes selected examples typical of results obtained from inclusion of Hf as a powder in the packs. It should be understood that the amount of Hf in the coating is unique to the coating process and the ingredients of the pack, for example, as shown by a comparison of Examples 1 and 5, 2 and 6, and 3 and 5. The unique result according to the present invention is the presence of Hf in the coating, in or on the article surface, in the range of 0.1–10 wt. %. As will be shown in connection with other examples, this level of Hf in such coating can be achieved in a variety of ways.

Because the amount of Hf in the coating resulting from Example 3 was at about 20 wt. %, outside the scope of the present invention, the coating was unsatisfactory because the high volume fraction of $HfO_2$ in the protective oxide produced on this specimen allowed rapid diffusion of oxygen through the protective layer causing premature failure of the coating, even earlier than the specimen of Example 4 with no Hf. The absence of Hf, as shown by Example 4, results in a coating life significantly lower than the coating associated with the present invention and represented by Examples 1, 2, 5 and 6.

EXAMPLE 7

Figure 3:
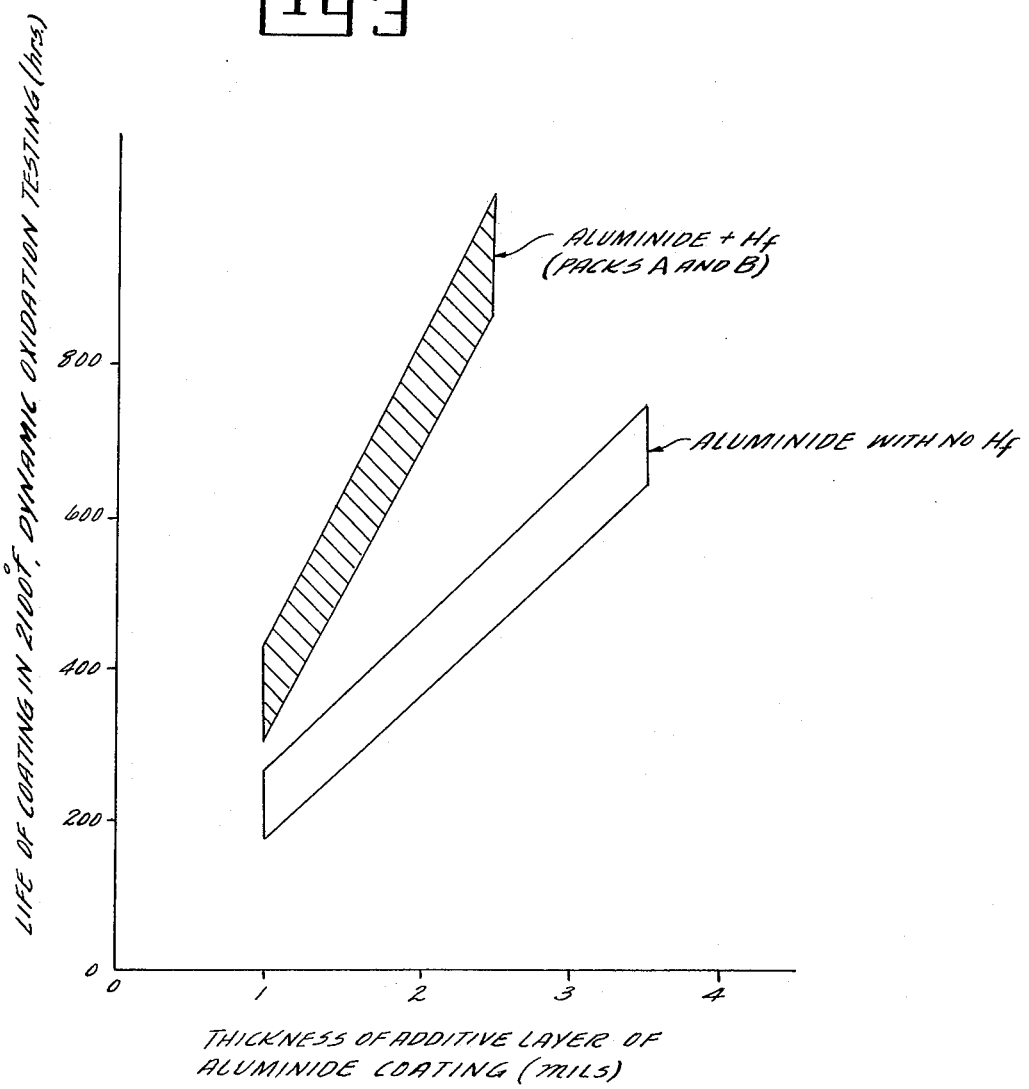
FIG. 3 is a graphical comparison of oxidation data of an aluminide coating on separate specimens of the same Ni-base superalloy, with and without the presence of Hf in the coating.

Comparison of 2100°F (1150°C) cyclic dynamic oxidation test data for specimens of the above-described René 120 alloy is shown in the graphical presentation of FIG. 3. Specimens of such alloy were processed in Pack A and in Pack B as in Examples 1–6 and in the Table to result in the same coating content. As can be seen from a vertical comparison of life at any thickness of the additive layer of the aluminide coating, the life of the coating associated with the present invention is about twice that of the same coating applied in the same substrate with the same thickness but without Hf. From these data, the significant effect of Hf on this type of coating is easily seen. As will be shown in subsequent examples, Hf has a similar effect on other types of metal coatings.

EXAMPLE 8

The coating procedure used in applying the coatings from Pack A described above was repeated on specimens of the René 120 alloy except that $HfF_4$ halide salt was substituted for the Hf metal powder as the source of hafnium. In this particular example, $HfF_4$ powder was included in the amount of 0.2 wt. % in the pack to result in 2% Hf in the resulting aluminide coating. Dynamic oxidation testing at 2100°F (1150°C) in the air of such a coating showed it to have about twice the life time of the above-described Pack A aluminide coating witih Hf.

As will be understood by those skilled in the metallurgical and metal coating arts, conduct of a coating process at a lower temperature than that included in the present examples will result in a slower and less efficient deposition rate. Thus, if lower temperatures are used, the amount of Hf available to react with the coating source metal can be adjusted to provide the desired amount of Hf in the coating, within the scope of the present invention. However, it has been recognized that inclusion of greater than about 10 wt. % Hf with the coating source material, irrespective of the form in which the Hf is used (for example Hf powder, as a Hf compound such a halide, as an alloy including Hf, etc.), is more detrimental than beneficial. This is shown by a comparison of Examples 3 and 4 in the Table. Thus, one form of the pack or coating mixture associated with the present invention includes Hf in the coating source in an amount of from a small but effective amount up to 10 wt. % Hf, which provides in a resulting coating the element Hf in the range of 0.1–10 wt. %.

EXAMPLE 9

The coating associated with the present invention can be attained by first sputtering, according to the well-known, commercially used process, a thin layer of Hf metal on the surface of an article to be protected and then aluminide coating, for example as has been described in previous examples. In one series of examples, such application of Hf to a thickness of about 0.02–0.04 mils, followed by aluminiding in accordance with Pack A described above resulted in 4–8 wt. % Hf in the coating. The same dynamic oxidation testing showed the coating life and resistance to be equivalent to that of coatings prepared as in Examples 1, 2, 5 and 6.

The present invention has been used in conjunction with a variety of coatings which can be applied in a number of ways and with the same beneficial results. For example, in commercial use are a group of coating alloys based on an element selected from Fe, Co or Ni and including such elements as Cr, Al and Y. One such system evaluated in connection with the present invention is described in the above-mentioned U.S. Pat. No. 3,528,861. Such a coating can be applied by physical vapor deposition, ion plating, sputtering, plasma spraying, etc. In addition, multiple, alternating layers of Fe, Co or Ni with Cr can be applied to the surface of an article to be protected, followed by the application of Al and Hf according to the present invention.

EXAMPLE 10

The above-described René 80 nickel-base superalloy was electroplated with two alternating coatings of Cr and Ni, the layers having a thickness of 0.1 and 0.2 mils, respectively. The surface thus coated was placed in a Pack A type mixture similar to that described in connection with the processing of the examples in the above Table, except that the ingredients of the pack in this example consisted essentially of, by weight, 40% of the ternary AlTiC coating source powder, 0.35% Hf powder, 0.2% $NH_4F$ with the balance of the pack being $Al_2O_3$. After processing for about 4 hours in the range of 1900°–1950°F (1038°–1066°C) in hydrogen, the surface was diffused and alloyed into a Ni-20%CR-20%Al-5%Hf coating. After 600 hours in the dynamic oxidation test described above, it was concluded from weight gain data and microstructural examinations that the coating prepared in this example would protect the René 80 alloy specimen between 1½ and 2 times longer than a similar coating without Hf.

From these examples, which are meant to be typical of rather than in any way limiting on the scope of the present invention, it will be readily recognized by those skilled in the art the variety of modifications and variations of which the present invention is capable, for example in respect to the compositions of alloys, packs, methods of application, etc. One unique feature of the present invention is that it provides for the formation of a composite surface oxide more stable than $Al_2O_3$ alone. Thus, the combination of aluminum and hafnium oxides of the present invention provides generally double or more the coating life for coatings with which it is formed. This is due at least partially to the unique keying arrangement of the coating's oxide scale with the underlying portion of the coating as a result of the combination of hafnium and aluminum oxides in the scale. It has been found that an element such as Zr, which also forms oxides more stable than $Al_2O_3$, does not provide such keying relationship.

What is claimed is:

1. A coating source powder useful in diffusion aluminide coating of a metal article consisting essentially of:

a powdered metal selected from the group consisting of Al and blaring alloys Al; and Hf in a powdered form of a material selected from the group consisting of Hf, alloys including Hf, and compounds of Hf, the Hf being included in the material in a range of from a small but effective amount up to 10 weight percent Hf which range provides 0.1–10 weight percent Hf in the coating.

2. The powder of claim 1 in which:

the Al is in the form of an alloy consisting essentially of, by weight, 50–70% Ti, 20–48% Al and 0.5–9% combined carbon; and the Hf is powdered Hf metal.

3. The powder of claim 1 in which:

the Al is in the form of an alloy consisting essentially of, by weight, about 51–61% Al, with the balance Fe, the alloy further characterized by being in the form of a two-phase structure of $Fe_2Al_5$ and $FeAl_3$;

and the Hf is powdered Hf metal.

* * * * *

UNITED STATES PATENT OFFICE
CERTIFICATE OF CORRECTION

PATENT NO. : 3,951,642

DATED : April 20, 1976

INVENTOR(S) : David R. Chang & John J. Grisik

It is certified that error appears in the above-identified patent and that said Letters Patent are hereby corrected as shown below:

Column 6, line 56 should read --of Al and Al-bearing alloys;and--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*